US009656135B2

(12) United States Patent
Lattimore

(10) Patent No.: US 9,656,135 B2
(45) Date of Patent: May 23, 2017

(54) PITCH MARK REPAIR DEVICE

(71) Applicant: Robert Lattimore, Skerries (IE)

(72) Inventor: Robert Lattimore, Skerries (IE)

( * ) Notice: Subject to any disclaimer, the term of this patent is extended or adjusted under 35 U.S.C. 154(b) by 0 days.

(21) Appl. No.: 14/763,709

(22) PCT Filed: Feb. 5, 2014

(86) PCT No.: PCT/EP2014/052244
§ 371 (c)(1),
(2) Date: Jul. 27, 2015

(87) PCT Pub. No.: WO2014/122172
PCT Pub. Date: Aug. 14, 2014

(65) Prior Publication Data

US 2015/0360103 A1 Dec. 17, 2015

(30) Foreign Application Priority Data

Feb. 5, 2013 (IE) ..... 2013/0034
Nov. 13, 2013 (IE) ..... 2013/0346

(51) Int. Cl.
*A63B 57/50* (2015.01)

(52) U.S. Cl.
CPC ..... *A63B 57/50* (2015.10)

(58) Field of Classification Search
CPC ..... A63B 57/50; B26B 11/001
(Continued)

(56) References Cited

U.S. PATENT DOCUMENTS 1,828,121 A * 10/1931 Adam ..... B26B 11/001 132/75
3,049,182 A * 8/1962 Pelow ..... A63B 57/50 172/378

(Continued)

FOREIGN PATENT DOCUMENTS

| | | |
|---|---|---|
| GB | 2393913 | 4/2004 |
| WO | 0010654 | 3/2000 |
| WO | 2011117425 | 9/2011 |

OTHER PUBLICATIONS

International Search Report for PCT/EP2014/052244, the international counterpart.

(Continued)

*Primary Examiner* — Steven Wong
(74) *Attorney, Agent, or Firm* — Warner Norcross & Judd LLP

(57) ABSTRACT

The present invention provides a pitch mark repair device (10) having an elongate body (12) which may be insertion into the ground in a direction (A) substantially parallel to a longitudinal axis of the body, the device additionally having a pair of arms (14) mounted to the body at or adjacent a first end of the arm and displaceable between a retracted position in which a free second end of the arm is disposed downstream of the first end with respect to the direction of insertion, through an intermediate position in which the arm projects substantially normally to the direction of insertion, to an extended position in which the second end is disposed upstream of the first end with respect to the direction of insertion, such that a pitch mark is drawn out through the action of the arms pulling on the surround earth as the device is withdrawn from the playing surface.

17 Claims, 3 Drawing Sheets

(58) Field of Classification Search
USPC ..... D21/793
See application file for complete search history.

(56) References Cited

U.S. PATENT DOCUMENTS

| | | | | | |
|---|---|---|---|---|---|
| 3,771,794 | A * | 11/1973 | Crockett | A63B 57/50 | 172/378 |
| 4,856,132 | A * | 8/1989 | Burns | A63B 57/00 | 7/114 |
| 5,322,130 | A * | 6/1994 | Ryden | A63B 57/50 | 172/371 |
| 6,162,137 | A * | 12/2000 | Jones | A24F 13/26 | 30/109 |
| 6,699,144 | B1 * | 3/2004 | Kvitek | A63B 57/50 | 473/406 |
| D580,455 | S * | 11/2008 | Elsener | D14/496 | |
| 2001/0029213 | A1 | 10/2001 | Hendren | | |
| 2003/0207730 | A1 * | 11/2003 | Braithwaite | A63B 57/207 | 473/408 |
| 2004/0048694 | A1 * | 3/2004 | Swensen | A63B 57/50 | 473/408 |
| 2004/0082410 | A1 * | 4/2004 | Noda | A63B 57/50 | 473/408 |
| 2004/0219997 | A1 * | 11/2004 | Champion | A63B 57/50 | 473/408 |
| 2007/0149325 | A1 * | 6/2007 | Vargas | A63B 57/207 | 473/408 |
| 2015/0217170 | A1 * | 8/2015 | Fallon | A63B 57/0068 | 473/408 |

OTHER PUBLICATIONS

International Written Opinion for PCT/EP2014/052244, the international counterpart.

* cited by examiner

PITCH MARK REPAIR DEVICE

FIELD OF THE INVENTION

The present invention is concerned with a pitch mark repair device, and in particular a pitch mark repair device which reduces the time and effort taken to repair a pitch mark in a sports surface such as a pitch or golf green.

BACKGROUND OF THE INVENTION

In the game of golf, when a golf ball lands on a putting green from a height it will leave an imprint or indentation (pitch mark) on the surface of the green. There is an established etiquette in the game that the player who made the pitch mark on the green should repair it. There are numerous patent applications filed for repairing pitch marks but many of these devices are over engineered, complex, and inefficient as evidenced by their general lack of use (e.g. GB2272648, GB2391818, and NZ331459).

There is a well known generic pocket tool used by many golfers that typically comprises two tapering prongs or tines attached to a rounded body suitable to hold between the forefinger and thumb. The repair is executed by continually inserting the tines into the turf around the pitch mark and levering the turf upwardly into the centre of the pitch mark. The final action is to tap down the area repaired with the base of a putter in order to smoothen out the repaired area of the pitch mark, which will often protrude slightly upwardly following the repair. This whole process is somewhat cumbersome, as evidenced by the number of pitch marks that are left unrepaired. There is also evidence to suggest that some golfers are unsure how to use the device, incorrectly using the tines to lift the turf up.

It is therefore an object of the present invention to provide an alternative pitch mark repair device which is both extremely simple to use, and extremely effective in repairing a pitch mark in a playing surface.

SUMMARY OF THE INVENTION

According to the present invention there is provided a pitch mark repair device comprising an elongate body adapted for insertion into the ground in a direction substantially parallel to a longitudinal axis of the body; at least one arm mounted to the body at or adjacent a first end of the arm and displaceable between a retracted position in which a free second end of the arm is disposed downstream of the first end with respect to the direction of insertion, through an intermediate position in which the arm projects substantially normally to the direction of insertion, to an extended position in which the second end is disposed upstream of the first end with respect to the direction of insertion.

Preferably, the arm is biased towards the retracted position.

Preferably, the arm is hingedly mounted to the body at the first end of the arm.

Preferably, the biasing means comprises a spring.

Preferably, the spring comprises a coil spring wound at least partially around the first end of the arm.

Preferably, at least a portion of the arm is resiliently deformable.

Preferably, the arm is curved in a longitudinal direction.

Preferably, the arm is curved such that when in the intermediate position the free end is pointing away from the direction of insertion.

Preferably, the free second end comprises a blunt tip.

A pitch mark repair device according to any preceding claim comprising a stop arranged to arrest the arm at the retracted position.

Preferably, the free second end projects outwardly of an outer surface of the body when the arm is in the retracted position.

Preferably, the device comprises a pair of arms spaced from one another.

Preferably, the arms are arranged to extend in substantially opposed directions when in the intermediate positions.

Preferably, the first end is fixed relative to the body, the arm being at least partially resiliently deformable between the retracted position and the extended position.

Preferably, the resilience of the arm acts to bias the arm towards the retracted position.

Preferably, the device comprises a handle.

Preferably, the body and the handle are formed integrally with one another.

Preferably, the body is retractable at least partially into the handle.

DETAILED DESCRIPTION OF THE DRAWINGS

Referring now to FIGS. 1 to 6 there is illustrated a first embodiment of a pitch mark repair device according to the present invention, generally indicated as (10), which is intended to be used in repairing a pitch mark in a playing surface such as a golf green by pressing the device downwardly into such a pitch mark and then simply withdrawing the device (10). This action actuates the device (10) as hereinafter described in order to repair the pitch mark during the step of withdrawing the device (10).

Figure 2:
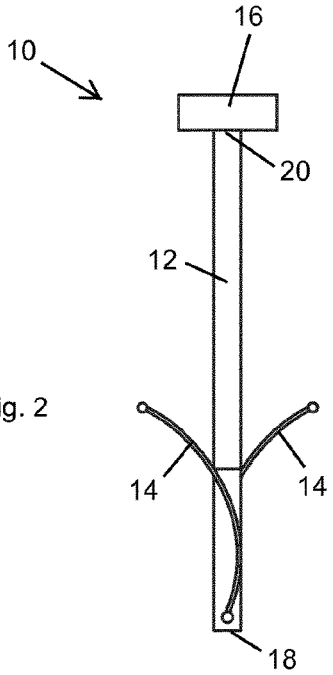
FIG. 2 illustrates a side elevation of the device of FIG. 1, in which a pair of arms are in a retracted position.
Figure 3:
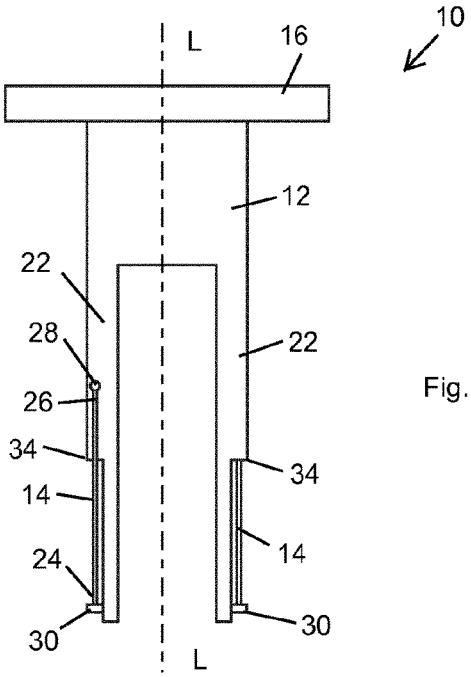
FIG. 3 illustrates a front elevation of the device of FIGS. 1 and 2.

The device (10) comprises a body (12) which in the embodiment illustrated is elongate in form in a longitudinal direction indicated by a longitudinal axis LL shown in FIG. 3. In addition the body (12) is relatively narrow in thickness, as can be seen for example in FIG. 2, and this elongate narrow form allows the body (12) to be pressed downwardly into a playing surface with relative ease, as required in order to effect operation of the device (10) to repair a pitch mark, and as described in detail hereinafter.

Figure 7:
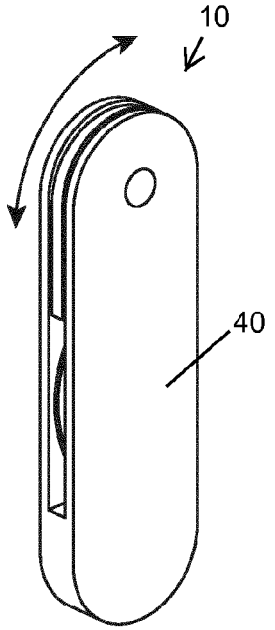
FIG. 7 illustrates a perspective of the pitch mark repair device of FIGS. 1 to 4, but having an alternative handle into which a body of the device is retractable.
Figure 8:
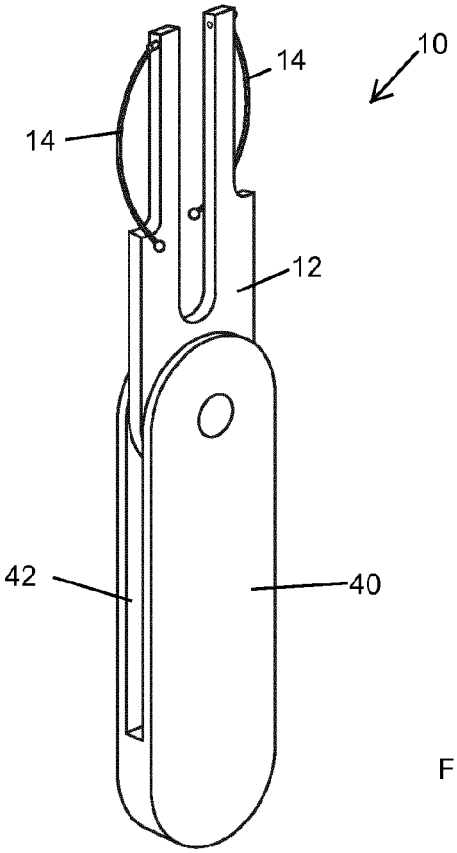
FIG. 8 illustrates the embodiment of FIG. 7 in which the body is extended from within the handle.
Figure 5:
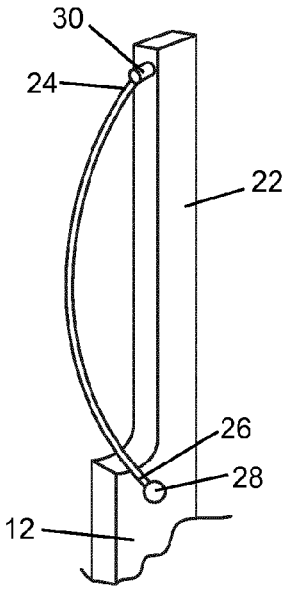
FIG. 5 illustrates an enlarged perspective view of a portion of the device illustrated of FIGS. 1 to 4.
Figure 6:
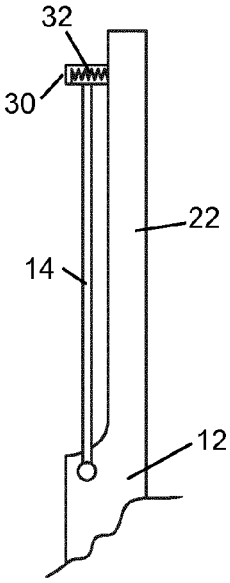
FIG. 6 illustrates a front elevation of the view shown in FIG. 5.
Figure 9:
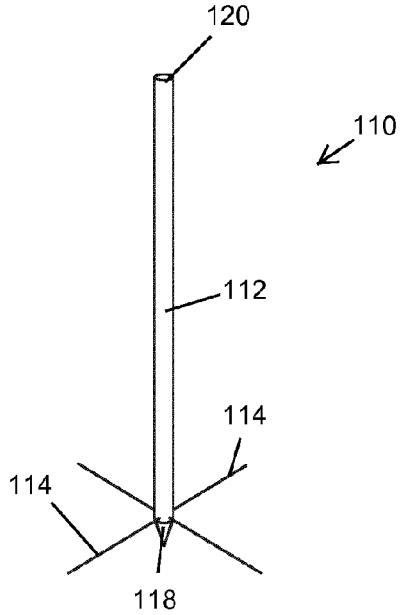
FIG. 9 illustrates a schematic representation of a further alternative embodiment of a pitch mark repair device according to the present invention.

The device (10) additionally comprises a pair of arms (14) which are mounted to the body (12) in the region of a lower free end of the body (12) and as will be described in greater detail. The device (10) may additionally comprise a handle (16) separate from the body (12), which can be used to grip the device (10) during insertion and removal of the device (10) from the pitch mark. It will however be appreciated that the handle (16) could be omitted, and the body (12) gripped directly to function as a handle. Any other suitable handle may of course be provided, for example as shown in FIGS. 7 and 8 described below. It will also be appreciated from the following description that although two arms (14) are preferred for the efficient operation of the device, more or less arms could be employed.

Figure 1:
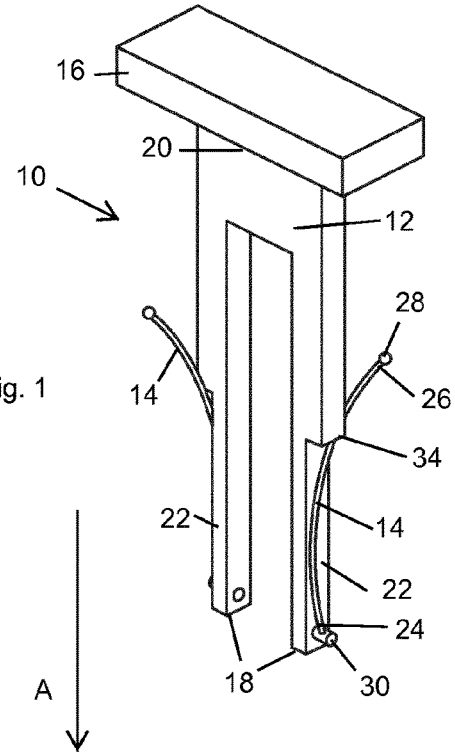
FIG. 1 illustrates a perspective view of the pitch mark repair device according to an embodiment of the present invention.
Figure 4:
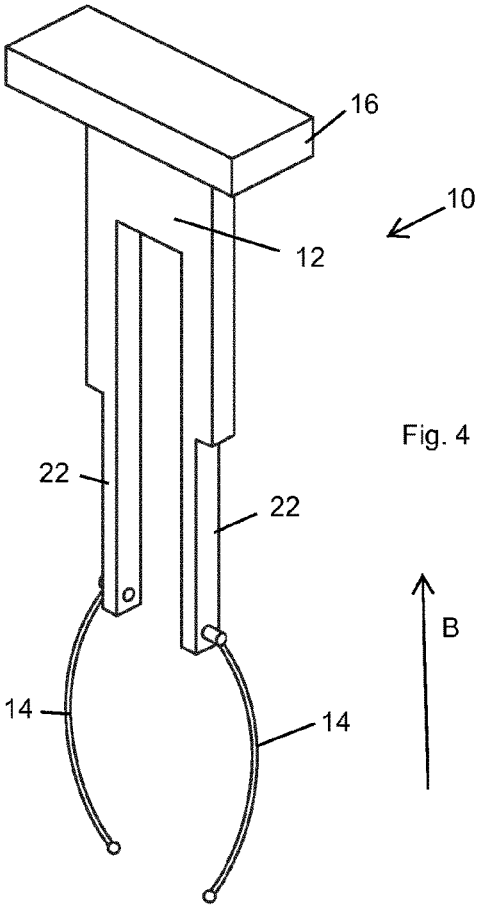
FIG. 4 illustrates a perspective view of the pitch mark repair device of FIGS. 1 to 3, in which the pair of arms are in an extended position.

The body (12) defines a proximal end (18) and a distal end (20), the proximal end (18) forming a working end of the device (10) which is intended to be inserted into the pitch mark in a first direction, indicated by the arrow A in FIG. 1, and which is then removed or withdrawn in an opposed second direction indicated by the arrow B in FIG. 4. In the embodiment illustrated the body (12) is forked at the proximal end (18) such as to define a pair of tines (22) which serve to further reduce the cross sectional area of the body (12) for the purposes of minimizing the force required to insert the proximal end (18), and the arms (14), into the playing surface. One of the arms (14) is mounted to each tine (22), at or adjacent the proximal end (18) of the body (12). Each arm (14) defines a first end (24) at which the arm (14) is mounted to the body (12), and a free second end (26), which is preferably provided with a blunt tip (28) in order to prevent injury or damage being caused by the free end (26), for example when the device (10) is located in a user's pocket or the like.

The pair of arms (14) are preferably hingedly or pivotally connected to the respective tine (22) at the first end (24). In the embodiment illustrated each arm (14) includes a pivot pin (30) which is retained in a corresponding aperture in the tine (22), although it should be understood that any other suitable means of pivotally mounting the respective arm (14) may be employed, and for example, the arm (14) could be turned through 90° at the first end (24) in order to form an integral pivot pin.

Each arm (14) is displaceable between a retracted position as illustrated in FIG. 1, through an intermediate position in which the arms (14) extend substantially normally to the longitudinal axis LL, to an extended position as illustrated in FIG. 4 in which the pair of arms (14) have rotated through 180° from the retracted position. In the fully retracted position the free second end (26) of each arm (14) is located downstream of the first end (24) with respect to the direction of insertion as indicated by arrow A in FIG. 1, while in the fully extended position each second end (26) is located upstream of the respective first end (24) with respect to the direction of insertion of arrow A. Each arm (14) is displaceable through this range by rotating about the respective pivot pin (30). The arms (14) are however preferably biased towards the retracted position, preferably by means of a spring (32) (shown only in FIG. 6) which may be of any suitable form, for example a coil spring wound internally or externally of the pivot pin (30), or by any other suitable arrangement. The spring (32) thus serves to retain the respective arm (14) in the retracted position, in addition to providing resistance to displacement of the arm (14) from the retracted position towards the fully extended position such as to urge the arm (14) back into the retracted position.

In order to prevent the action of the spring (32) from displacing the respective arm (14) passed the fully retracted position, the device (10) preferably comprises a stop in the form of a shoulder (34), one formed in each of the tines (22), against which the arm (14) comes to rest when in the retracted position, thereby arresting the further displacement of the arm (14). The stop (34) could of course be replaced with any other suitable alternative, for example a magnet or the like that holds the arm (14) in the desired position prior to deployment.

When in the fully retracted position, in particular as seen in FIGS. 1 and 2, each arm (14) lies substantially in the plane of the body (12), with the free second end (26) projecting outwardly beyond the outer surface or profile of the body (12). The arms (14) are however arranged to such that the free second ends (26) project beyond opposed sides of the body (12). In this way, when the device (10) has been fully inserted into a pitch mark in a playing surface and a user begins to remove or withdraw the device (10), the free second ends (26) which are projecting slightly outwardly from the body (12), will each function as a barb which will be caught by the passing earth and force the arms (14) to be rotated outwardly away from the fully retracted position towards the intermediate position. Thus the action of withdrawing the device (10) in the direction of arrow B will force each of the arms (14) outwardly, but in opposite directions to one another, such that on reaching the intermediate position the pair of arms (14) extend in substantially opposite directions to one another. In the intermediate position the arms (14) are extended substantially normally to the longitudinal axis LL, and thus the direction of withdrawal of arrow B, and will therefore act to engage and grip the slightly compressed earth beneath the pitch mark and draw the surrounding earth upwardly during the continued withdrawal of the device 10.

This continued withdrawal will quickly force the arms (14) to rotate past the intermediate position to the fully extended position as illustrated in FIG. 4, in which the free second ends (26) are located upstream of the first ends (24) with respect to the direction of insertion of arrow A, or alternatively are located downstream of the first ends (24) with respect to the direction of retraction of arrow B. This allows the remainder of the body (12) and the arms (14) to be easily withdrawn from the now repaired pitch mark with minimum resistance due to the small cross sectional area of the arms (14). By substantially aligning the arms, lengthwise, with the longitudinal axis LL, no damage is caused to the playing surface as the arms (14) exit. As soon as the arms (14) are drawn clear of the ground the pair of springs (32) will cause the arms (14) to return to the fully retracted position, where they will be arrested by the respective shoulder (34). The device (10) is thus immediately ready to be used again.

It will therefore be understood that the design of device (10) is such that, with the arms (14) in the retracted position and lying substantially in the plane of the body (12), the free second end (26) of each of the arms (14) and points away from the ground as the device (10) is inserted in the direction of arrow A. Very little resistance to insertion is experienced, allowing the body (12) to be fully inserted into a pitch mark, to a point at least past the free second ends (26). At this stage the device (10) can then be drawn outwardly of the pitch mark, causing the arms (14) to unfurl outwardly towards the intermediate or substantially horizontal position. The curvature of the arms (14) serves to locate each free second end (26) outwardly of the body (12) to catch the surrounding earth as the device (10) is withdrawn in the direction B. The arms (14) could however be relatively straight as opposed to curved, with a suitable shaping or deformation to the second ends (26) in order to ensure that said ends (26) project outwardly of the profile of the body (12). During this retraction there is a short period when the arms (14) are located in the intermediate position and thus pull upwardly on the concave depression of the pitch mark to restore the pitch mark to its pre-compressed state. The arms (14) will, however, quickly rotate beyond the intermediate position towards the fully extended position illustrated in FIG. 4, allowing the arms (14) to be withdrawn from the ground without causing damage thereto. However, if a pitch mark is very deep or the ground is very soft, a further application of the device (10) may be required.

Referring to FIGS. 7 and 8, the device (10) is shown with an alternative handle (40) replacing the handle (16) shown in FIGS. 1-4, and to which the body (12) is rotatably coupled about one end of the handle (40). The handle (40) additionally defines a recess (42) into which the body (12), including the pair of arms (14), may be rotated or retracted for storage. When the device (10) is required to repair a pitch mark, the body (12) is rotated from the retracted position illustrated in FIG. 7 to the extended position illustrated in FIG. 8, at which point the device (10) can be used as hereinbefore described.

Referring now to FIGS. 9 -13, there is illustrated, schematically, an alternative embodiment of a pitch mark repair device according to the present invention, generally indicated as (110). In this alternative embodiment, like components have been accorded like reference numerals and unless otherwise stated perform a like function. The device (110) comprised a body (112) which also serves as a handle by which the device (110) may be operated. The body (112) comprises a proximal end (118) and a distal end (120), in addition to four arms (114) which are secured to the body (112) about the proximal end (118). The arms (114) are perfectly equally spaced from one another, in order to apply equal upward pressure to the pitch mark when being withdrawn from the ground, as described hereinafter in detail. It will however be appreciated that the number and spacing of the arms (114) may be varied.

Each arm (114) defines a first end (124) which is secured to the body (112), and a opposed free second end (26). In this embodiment, rather than the arms (114) being hingedly mounted to the body (112) the arms (114) are at least partially formed from a resiliently deformable material which enables the arms (114) to be deformed between the retracted, intermediate and extended positions as hereinafter described. This avoids the requirement to have a pivot mounting of the arms (114), as set out hereinafter, also removes the requirement for a spring, thereby reducing both the cost and complexity of the device (110).

Figure 10:
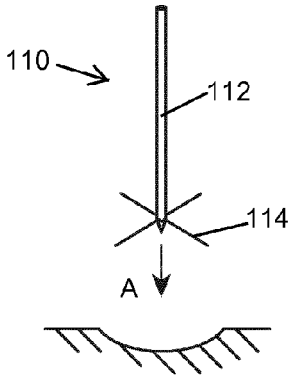
FIG. 10 illustrates the repair device of FIG. 9 located directly above a pitch mark in preparation for insertion into the pitch mark.

FIGS. 10-13 illustrate a sequence of steps demonstrating the operation of the device (110). Referring to FIG. 10 the device (110) is pushed downwardly in a first direction A towards the compressed pitch mark, the arms (114) projecting radially outwardly in a direction substantially normal to a longitudinal axis of the body (112).

Figure 11:
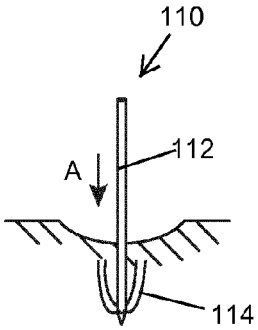
FIG. 11 illustrates the repair device of FIG. 9 having been inserted vertically downward through the centre of the pitch mark.

Turning to FIG. 11, as the proximal end (18) contacts and is pressed into the pitch mark, the arms (114) will be deformed rearwardly or downstream with respect to the direction of insertion indicated by arrow A.

Figure 12:
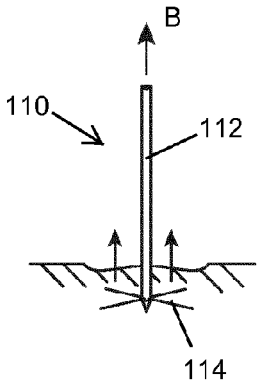
FIG. 12 illustrates the repair device of FIG. 9 having been partially withdrawn or retracted from within the pitch mark, in order to displace a number of arms into an intermediate position.

FIG. 12 illustrates the device (110) being initially withdrawn from the ground, through which action the arms (114) are forced to unfurl outwardly back into the intermediate position, gripping the surrounding earth and pulling the compressed pitch mark upwardly to restore same.

Figure 13:
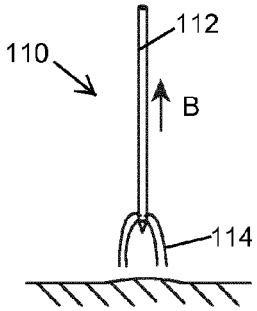
FIG. 13 illustrates the pitch mark repair device of FIG. 9 having been fully retracted or removed from within the pitch mark, thereby repairing the pitch mark.

In FIG. 13 it can be seen that the continued withdrawal of the device (110) in the direction of arrow B, forces the arms (114) to be deformed into the fully extended position in which the arms (114) are pointing downwardly away from the body (112), allowing the device (110) and the arms (114) to be withdrawn from the ground with minimum resistance and without causing any damage to the ground. At this point, the resilience of the arms (114) will return the arms (114) to the intermediate position. It should however be understood that the arms (114) could be arranged to rest, when the device (110) is not in use, in the fully retracted position, and the resilience thereof will permit the arms (114) to deformed outwardly from the retracted position into the intermediate position and beyond to the fully extended position. The resilience of the arms (114) thus provides the bias to return the arms (114) to the desired starting position.

It should also be understood that the arms (114) could alternatively be formed from a more rigid material and pivotally or otherwise mounted to the body (112).

The device (10,110) of the present invention thus provides a simple yet highly effective means of repairing a pitch mark.

The invention claimed is:

1. A pitch mark repair device comprising an elongate body adapted for insertion into the ground in a direction substantially parallel to a longitudinal axis of the body; at least one arm mounted to the body at or adjacent a first end of the arm in a manner which enables the arm to be displaceable between a retracted position in which a free second end of the arm is disposed downstream of the first end with respect to the direction of insertion, through an intermediate position in response to withdrawal of the device from the ground in which the arm projects substantially normally to the direction of insertion to allow the arm to engage and grip the surrounding ground, to an extended position in response to the continued withdrawal of the device from the ground in which the second end is disposed upstream of the first end with respect to the direction of insertion, wherein a tip of the free second end projects outwardly of an outer surface of the body when the arm is the retracted position to facilitate movement of the arm from the retracted position to the intermediate position.

2. A pitch mark repair device according to claim 1 in which the arm is biased towards the retracted position.

3. A pitch mark repair device according to claim 1 in which the arm is hingedly mounted to the body at the first end of the arm.

4. A pitch mark repair device according to claim 1 in which the biasing means comprises a spring.

5. A pitch mark repair device according to claim 4 in which the spring comprises a coil spring wound at least partially around the first end of the arm.

6. A pitch mark repair device according to claim 1 in which at least a portion of the arm is resiliently deformable.

7. A pitch mark repair device according to claim 1 in which the arm is curved in a longitudinal direction.

8. A pitch mark repair device according to claim 7 in which the arm is curved such that when in the intermediate position the free end is pointing away from the direction of insertion.

9. A pitch mark repair device according to claim 1 in which the free second end comprises a blunt tip.

10. A pitch mark repair device according to claim 1 comprising a stop arranged to arrest the arm at the retracted position.

11. A pitch mark repair device according to claim 1 comprising a pair of arms spaced from one another.

12. A pitch mark repair device according to claim 11 in which the arms are arranged to extend in substantially opposed directions when in the intermediate positions.

13. A pitch mark repair device according to claim 1 in which the first end is fixed relative to the body, the arm being at least partially resiliently deformable between the retracted position and the extended position.

14. A pitch mark repair device according to claim 7 in which the resilience of the arm acts to bias the arm towards the retracted position.

15. A pitch mark repair device according to claim 1 comprising a handle.

16. A pitch mark repair device according to claim 15 in which the body and the handle are formed integrally with one another.

17. A pitch mark repair device according to claim 15 in which the body is retractable at least partially into the handle.

* * * * *